US008056446B1

(12) United States Patent
Wheeler et al.

(10) Patent No.: US 8,056,446 B1
(45) Date of Patent: Nov. 15, 2011

(54) RATCHETING ADJUSTABLE WRENCH

(76) Inventors: Dale K Wheeler, Fallston, MD (US); Thomas J Wheeler, Pomona, CA (US)

( * ) Notice: Subject to any disclaimer, the term of this patent is extended or adjusted under 35 U.S.C. 154(b) by 304 days.

(21) Appl. No.: 12/402,481

(22) Filed: Mar. 11, 2009

Related U.S. Application Data

(60) Provisional application No. 61/068,851, filed on Mar. 11, 2008.

(51) Int. Cl.
*B25B 13/46* (2006.01)
*B25B 7/12* (2006.01)

(52) U.S. Cl. ..... 81/58; 81/405; 81/356; 81/363; 81/408; 81/358

(58) Field of Classification Search ..... 81/58, 58.2, 81/318, 319, 321, 325, 329, 339, 341, 343, 81/347, 352–356, 385–387, 393, 405, 90.1, 81/90.2, 90.9, 126, 128, 129, 129.5
See application file for complete search history.

(56) References Cited

U.S. PATENT DOCUMENTS

| | | | | | |
|---|---|---|---|---|---|
| 531,125 | A | * | 12/1894 | Lind | 81/90.2 |
| 824,082 | A | * | 6/1906 | Reynolds | 81/90.2 |
| 1,181,654 | A | * | 5/1916 | Eifel | 81/319 |
| 3,505,915 | A | * | 4/1970 | Rydell | 81/355 |
| 5,140,876 | A | * | 8/1992 | Fields | 81/408 |
| 5,385,072 | A | * | 1/1995 | Neff | 81/405 |

* cited by examiner

*Primary Examiner* — Debra S Meislin
(74) *Attorney, Agent, or Firm* — Gary Hoenig

(57) ABSTRACT

The invention is a ratcheting open ended wrench comprising a main body having an elongate primary handle portion and an upper stationary jaw element, a secondary handle opposed to the primary handle portion and having a binding surface at the top being pivotally attached to the main body, a tertiary handle pivotally attached to the main body having a gear element cooperating with a geared end of a connecting rod, the opposing end pivotally and slidably fixed to a lower movable jaw assembly, the lower movable jaw assembly being spring biased against the upper stationary jaw and positioned within a main body guide slot so that the secondary handle binding surface contacts the lower jaw assembly and activation of the secondary handle clamps the lower movable jaw assembly relative to the upper stationary jaw. Activation of the tertiary handle counteracts the lower movable jaw spring bias to open the jaws.

14 Claims, 5 Drawing Sheets

RATCHETING ADJUSTABLE WRENCH

FIELD OF THE INVENTION

The present invention relates to the field of hand wrench tools. More particularly, this invention is directed to an open ended wrench tool with adjustable jaws operable for clamping, and a ratchet mechanism for providing a free return stroke of the handle.

BACKGROUND OF THE INVENTION

Prior art adjustable open ended wrenches typically incorporate a thumb wheel or similar mechanism to adjust the jaw opening size of the wrench so as to snugly grasp a faceted head of a workpiece, such as a fastener. A snug grip is important to maximize the contact surface area between the jaws and the workpiece thereby avoiding damage, principally resulting from slippage and point contact deformation, to the fastener as torque is applied to a workpiece. The typical adjustable open ended wrench maintains a fixed jaw opening size once adjusted to fit the fastener. As the fastener is rotated, the user must reposition the tool so as to restore a convenient position of the tool handle to once again apply torque. The repositioning action requires a user to lift or slide the jaw opening away from the workpiece disengaging the tool from the workpiece, repositioning, and reengaging the tool with the workpiece. The disadvantage of lifting and repositioning of the tool is well recognized and the inconvenience is typically sacrificed in favor of the convenience of the adjustable open ended features for particular applications requiring side access to a fastener or minimizing the need for stowing multiple fixed sized sockets or wrenches. Ratcheting wrenches provide a mechanism to rotate the fastener without removing the wrench from the fastener and typically incorporate a jaw or socket mechanism that surrounds the fastener head requiring approaching the fastener from above. Consequently a user must make an election as to the type of wrench to use in a particular application and must also provide multiple variations of the tools thereby expanding tool kit required so as to be prepared for a wide variety of applications.

Numerous attempts have been pursued to improve the performance of adjustable open ended wrenches principally directed to providing some form of ratcheting wherein the tool need not be disengaged or removed from the workpiece for repositioning the tool handle after each torquing stroke. One such attempt is illustrated by Brown in U.S. Pat. No. 6,889,579 wherein a cam action is taught to position a series of jaw elements movable radially from the workpiece so as to selectably clamp on to a hex fastener for rotation of the workpiece during the torque stroke and released during repositioning; however, the jaw mechanism is not open ended, the jaw size range is limited, and no ratcheting mechanism is provided.

Other prior art attempts incorporate a quasi ratcheting mechanism wherein an element of the tool provides for a small motion of a jaw element either selectably by an operator activated lever mechanism or by an incorporated element in the tool activated by the action of rotating the engaged tool in a particular direction. True ratcheting mechanisms remain fully engaged with a workpiece at all times during torque application and rotational repositioning of the tool handle. Typical quasi ratcheting mechanisms have a disadvantage in that the workpiece can be firmly gripped often resulting in slippage and damage to the fastener.

Janson, in U.S. Pat. No. 5,941,142, teaches a wrench having a quasi ratcheting function wherein the handle is rotated backwards to reset the handle for a torque stroke in 60 degree increments without removing the tool from the workpiece or loosening the fastener. True ratchets can be reset in much smaller increments. Brown wrenches employ the typical method of adjusting the open ended jaw opening size by turning a worm gear that operates on a rack attached to the movable jaws. Quasi ratcheting is typically accomplished by incorporating a movable element within one jaw face allowing the tool to clamp against a workpiece in the torque stroke direction and releasing the workpiece in the reverse free return stroke direction wherein the jaw faces slip to the next facet of the workpiece. The span of movement of the movable element is typically small thus a resizing of the jaw openings requires manual adjustment of the opening to accommodate other workpiece sizes. Alternatively, a movable element is incorporated to provide small movement of one jaw of the tool away from the workpiece thusly effectuating a similar ratcheting action as. These prior art quasi ratcheting mechanisms, despite being an incremental improvement over traditional adjustable wrenches, are slow to adjust as the size range accommodated by the movable portion of the jaw face is typically small there by necessitating adjustment of the worm gear. Also prior art quasi ratcheting mechanisms generally do not clamp firmly onto a workpiece in part because the surface contact area on the workpiece is small due to larger tolerances resulting from the loose fit. A firm grip of the tool onto a workpiece is essential to prevent damage to a workpiece during the torque stroke.

What is needed is a wrench combining the advantageous features of an adjustable open ended wrench facilitating a variety of access approaches to a workpiece and minimizing the number of tools of varying jaw size, while also providing a ratcheting mechanism; and, a simple and rapid jaw opening size change mechanism having a firm clamping action to eliminate clearances and to prevent damage to fasteners thereby improving the utility of the tool and overcoming disadvantages of the prior art.

SUMMARY OF THE INVENTION

Accordingly, it is an object of the present invention to provide a new type of adjustable open end wrench having features to accommodate a range of sizes of faceted workpieces, a firm high tolerance grip of a workpiece, and having ratcheting capability.

The ratcheting open ended wrench according to the present invention has a primary handle incorporating an upper stationary jaw formed in the top end and a elongate primary handle formed in the bottom end. The upper stationary jaw is shaped with a flat workpiece contacting surface similar to traditional wrench thus forming one half of an open ended wrench jaw. A lower movable jaw assembly, forming the second half of an open ended wrench jaw is positioned opposite to the upper jaw, thus completing the jaw of an open ended wrench. The lower movable jaw has roller pins, performing as linear roller bearings, confined by guide slots in the primary handle wherein the guide slots are formed perpendicular to the jaw face such that the lower movable jaw face is free to be selectably positioned at a desired distance from the upper jaw face thereby providing a means to adjust the jaw opening size to accommodate various sizes of workpieces. The apparatus further has a negator spring biasing the lower jaw towards the upper jaw face such that the jaws are normally closed. A secondary handle pivotally fixed to the primary handle by means of a pendulum type pivot and receiver, has an elongate handle portion at one end and a cam shaped contacting surface formed in the opposing end. The secondary handle and pivot attachment is arranged such that the secondary handle portion opposes the primary handle portion and when drawn towards the primary handle portion results in the cam shaped binding surface to clamp against the lower movable jaw assembly, at a shallow angle, forcing a highly leveraged small motion of the lower jaw face towards the upper jaw face closing the jaws firmly against an engaged workpiece. A tertiary handle is further included, also being pivotally fixed to the primary handle and having a geared element opposing the handle end positioned opposing the primary handle and over the secondary handle, that cooperates with a geared end of connecting rod pivotally fastened to the lower jaw mechanism with the pivot slidable in a connector pin guide slot also in the primary handle. The connector pin guide slot is arranged parallel to the lower jaw assembly bearing guide slot. The tertiary handle, connecting rod, connecting rod pin and pin guide slot cooperate to move the lower jaw face away from the upper jaw face when the tertiary handle is activated thereby providing a means to open the jaw being normally closed by the negator spring so as to engage a workpiece.

Using the wrench requires the operator to open the negator spring biased jaws by activating the tertiary handle, position the jaws around a workpiece, release the tertiary handle and activate the secondary handle to firmly grip the workpiece and retain the jaw position in preparation for torquing. Releasing the secondary handle loosens the grip on the workpiece and frees the jaws thereby allowing the jaws to open during the free return stroke providing a quasi ratcheting mechanism. Once the wrench is repositioned for the next torque stroke, the operator again asserts the secondary handle to once again firmly grip the workpiece and retain the jaw position. It will be appreciated that the operator may apply the torque in either rotational direction once the workpiece is gripped as the jaws are clamped in position by the secondary handle until released. The activation force applied to the secondary handle provides a highly leveraged small motion forcing the jaws of the tool together and onto the workpiece whilst also clamping the jaws in position. With the secondary handle deactivated on the free return stroke, the jaws are free to open as required to clear the features of the workpiece during repositioning. The jaws nevertheless lightly remain in contact with the workpiece during the free return stroke resulting from the bias of the negator spring. When the tool is removed from the workpiece, the negator spring bias closes the jaws and the operator then returns to activating the tertiary handle to open the jaws.

The quasi ratcheting function applies high clamping force in the direction of torque application as the secondary handle is squeezed towards the primary handle. The free return stroke or quasi ratchet stroke requires the secondary handle to be held loosely by the operator to allow the lower movable jaw assembly to open slightly as required by the camming action of a faceted workpiece against the jaw faces. In the case of a hex fastener, the primary handle can be rotated for repositioning during the return stroke in increments of 60 degrees before initiating a new torque stroke. The wrench maybe used as a typical open ended wrench as once the wrench is clamped to a workpiece, the wrench may be rotated around the fastener in either direction without loosening the grip of the fastener.

The integral linear roller bearings incorporated into the lower movable jaw assembly minimize the force transfer losses thereby producing greater clamping pressure and efficiency then wrench not incorporating such an element.

The normally closed jaw can be rapidly sized for a specific fastener by squeezing the tertiary handle then releasing the handle to allow the jaw opening to match the fastener size. The spring loaded jaws eliminate clearances between the jaws and the fastener reducing damage to the fastener during torque. The procedure for adjusting the jaw size is thereby much faster than using either the worm gear adjust of a typical adjustable crescent wrench or the screw adjustment on the handle end of a locking style gripping plier.

Furthermore, the wrench provides a high mechanical advantage similar to a locking style gripping plier type tool while providing a non-locking function similar to a channel locking pliers thereby combining high workpiece clamping force with ease of use.

Manufacturing costs may be minimized as the present invention design is suitable for constructing the load bearing and major components using laminated metal plate or sheet manufacturing techniques.

The wrench accordingly provides numerous advantages over the prior art including quick size adjustment, quasi ratcheting, leveraged and high tolerance gripping of the workpiece, ease of use, and low cost construction.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

DETAILED DESCRIPTION OF THE INVENTION

Figure 1:
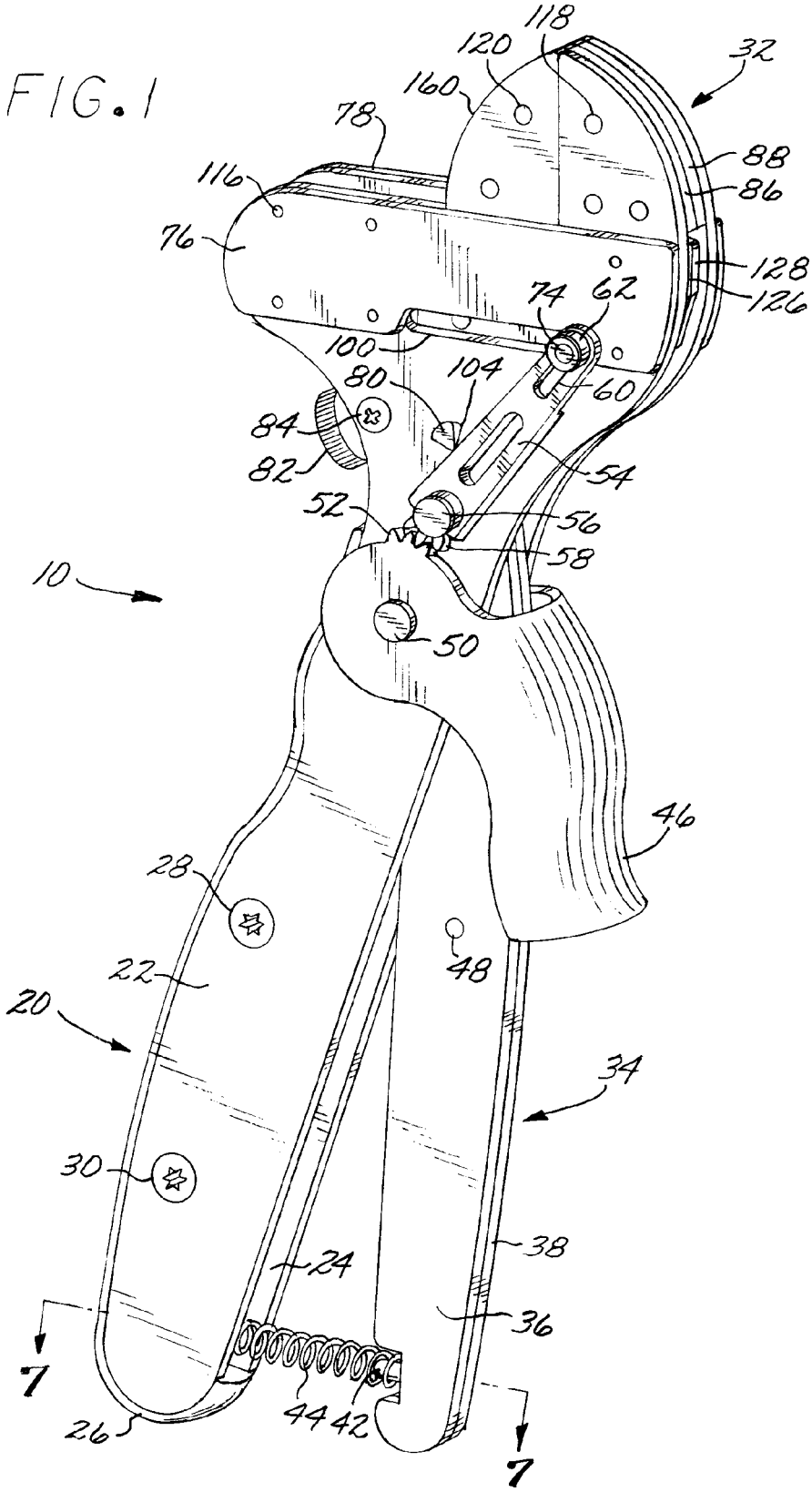
FIG. 1 is a perspective view of an embodiment of the open ended ratcheting wrench according to the present invention.

Although particular embodiments of the invention have been described in detail for purposes of illustration, various modifications may be made without departing from the spirit and scope of the invention. Accordingly, the invention is not to be limited except as by the appended claims. Referring now in greater detail to the various figures of the drawings wherein like reference characters refer to like parts, there is shown in a perspective view at 10 in FIG. 1, a new type of adjustable ratcheting open ended wrench.

Figure 11:
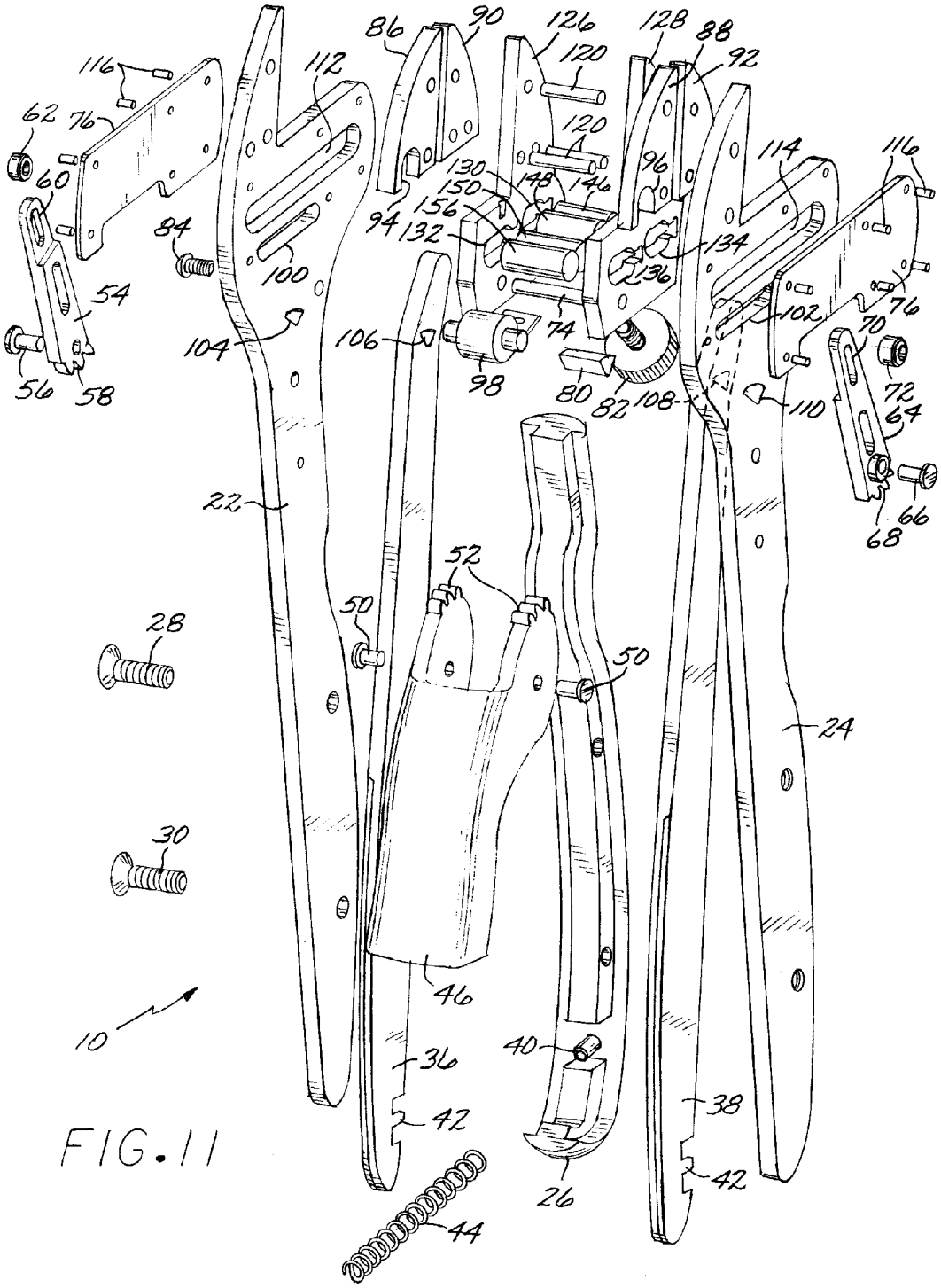
FIG. 11 is an exploded view of the open ended ratcheting wrench according to the present invention.

FIG. 1 and FIG. 11 illustrate an embodiment of the adjustable open ended wrench 10 according to the present invention comprising a primary handle 20 having an elongate primary handle grip portion forming the bottom and an upper stationary jaw element 32 forming the top, a secondary handle 34 having an elongate gripping portion positioned opposed to the primary handle 20 grip portion and a cam shaped binding surface 124 at the top being pivotally attached to the primary handle 20 at 104 by means of a pendulum type pivot 80 retained by a pendulum pivot type receiver 104 in the primary handle 20, a tertiary handle 46 pivotally attached to the main body having a gear element 52 cooperating with a geared end 56 of a connecting rod 54, the opposing end of the connecting rod pivotally fixed with connecting rod pin 74, retained by pin retainer 60, and slidable through a guide slot 60 in the connection rod 54 and a cooperating guide slot 104 in the primary handle 20, to a lower movable jaw assembly 160, the lower movable jaw assembly 160 being spring biased against the upper stationary jaw and positioned within a jaw roller guide slot in the primary handle and also being positioned such that the secondary handle 34 cam shaped binding surface 124 contacts the lower movable jaw assembly 160 such that a squeezing action by an operator of the secondary and primary handles clamps the position of the lower movable jaw assembly 160 relative to the upper stationary jaw 32 and activation of the tertiary handle 46 counteracts the lower movable jaw assembly 160 spring bias so as to open the jaws. A number of the elements have complementary counterparts in this embodiment utilizing laminate construction and are described in more detail below; however, the afore disclosed elements are the essential elements of the invention.

It should be noted the figures illustrate an embodiment of the present invention utilizing laminated metal sheet construction techniques whereby particular components are created by stacking or laminating elements together and duplicating some components to improve durability and strength. It will be appreciated that the invention may also be constructed having functionally identical components using other manufacturing techniques wherein duplicating and complimentary components may not be required in alternate embodiments and therefore are within the scope and spirit of the invention. The laminated construction of this embodiment reduces the manufacturing costs and thereby satisfies an objective of the invention.

Being of laminated construction, as shown in FIG. 1, the primary handle 20 comprises a primary handle spacer 26 mounted between first and second primary handle plates 22 and 24 and fastened together by a first handle fastener 28 and a second handle fastener 30 wherein the fasteners are mounted through holes in the first primary handle plate 22, through holes in the primary handle spacer 26, and received by threaded holes in the second primary handle plate 24.

Figure 7:
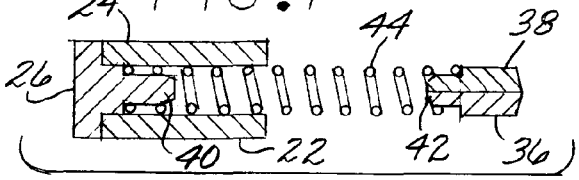
FIG. 7 is a cross section view taken on Line 7-7 of FIG. 1 showing the secondary handle return spring as retained by opposing bosses, one in the handle spacer and one formed by the secondary handle elements.

Referring to FIG. 1 and FIG. 11, an exploded view of the invention, the handle spacer 26 provides clearance between the first 22 and second 24 primary handle plates so as to accommodate a secondary handle 34 and a lower movable jaw assembly 160 positioned in between. The secondary handle 34 comprises a first and second secondary handle plate, 36 and 38 respectively laminated together by secondary handle pin 48. The secondary handle 34, as an assembly, provides an elongate bottom forming the handle grip portion, a pendulum pivot pin mounting hole, defined at 106 and 108 respectively in the first and second secondary handle plates, 36 and 38, near the top end and a cam shaped contact surface 124 at the top end. The secondary handle 34 is retained in the primary handle 20 by pendulum pivot pin 80 being restrained by pendulum pivot pin receivers 104 and 110 in the first and second primary handle plates 22 and 24 and located above the handle grip portions of both the primary and secondary handles such that the handle grip portions of the primary and secondary handles oppose each other and operate in a scissor type fashion. As detailed in FIG. 7, the primary and secondary handle grip portions are biased away from each other using a tension or compression spring 44 that is retained in the assembly by boss 42 in the secondary handle 34 and boss 40 in the handle spacer 26. As the embodiment construction is laminated, the secondary handle boss 42 is a two half design wherein one half is provided by the first secondary handle plate 36 and the other by the second secondary handle plate 38.

Referring again to FIG. 1 and FIG. 11, a lower movable jaw assembly 160 provides a jaw face 156 opposing the upper jaw element portion 32 jaw face 158 thereby forming a traditional open ended wrench jaw set. The lower movable jaw assembly 160 slides between the first and second primary handle plates 22 and 24 in jaw roller guide slots 112 and 114 which can be seen in FIG. 11. The jaw roller guide slots 112 and 114 are arranged perpendicular to the faces of the lower movable jaw assembly and the upper jaw element thereby permitting the wrench jaw to open to engage a workpiece by sliding the lower movable jaw assembly away from the upper jaw. In brief, the secondary handle 34 cam shaped binding surface at its top end contacts the bottom of the lower movable jaw assembly 160 so as to clamp the lower movable jaw assembly 160 in position and engage the workpiece.

The tertiary handle 46 is provided for opening the spring biased normally closed jaws of the tool. The tertiary handle 46 is pivotally attached to the primary handle 20 by rivets 50 and has an elongate handle portion extending downward and adjacent to the secondary handle 24. The opposing top end of the tertiary handle 46 has a gear element 52 engaging the transfer geared end 58 of connecting rod 54, pivotally attached to the primary handle 20 by pin 56, which is, in turn, pivotally attached at the top end of the connecting rod to the lower movable jaw assembly 160 by connecting rod guide pin 74 and retained in a connecting rod guide slot 60 positioned longitudinally at the top end of the connecting rod 54 and extending part of the length of the rod. The connecting rod pin 74 extends through the connecting rod pin guide slot 106 in the first primary handle plate 22, through the lower movable jaw assembly 160, onwards through a similar second connecting rod pin guide slot 108 in the second primary handle plate 24 and into a complementary second connecting rod 64 on the opposing outer face of the tool also having a connecting rod guide slot 70. The second connecting rod 64 is also pivotally fixed by pin 66 in a similar manner to the second primary handle plate 24 and also has a transfer geared end 68 at the bottom, rotatable around pivot pin 66, engaging the geared element 52 top end of the tertiary handle 46. When the operator squeezes the tertiary handle 46, the pivoting action around rivets 50 rotate the geared top ends 52 of the tertiary handle engaging the transfer gears 56 and 66 at the bottom ends of the connecting rods 54 and 64, leveraging the connecting rod guide pin 74 away from the upper jaw element 32 being guided by connecting rod pin guide slots 106 and 108 so as to leverage the attached lower movable jaw assembly 160 away from the upper jaw face 158. Note that the connecting rod guide slots 60 and 70 accommodate the shortening distance between the connecting rod pivots 56 and 66 and the connecting rod pin 74 as the tertiary handle 46 is activated. Also note that the connecting rods 54 and 64 retain the connecting rod pin 74 by pin rings 62 and 72 on either side of the tool.

Figure 2:
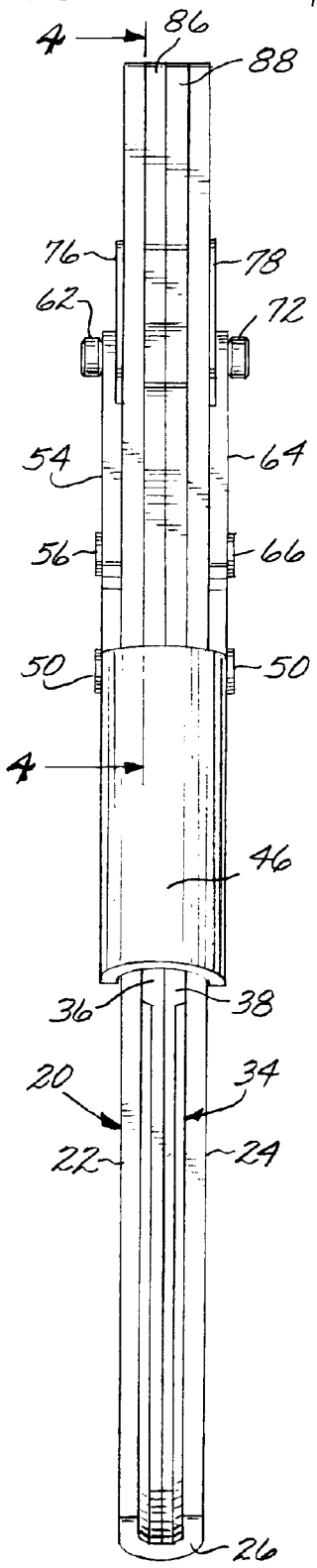
FIG. 2 is a side view of the open ended ratcheting wrench showing the positioning of the tertiary handle used for opening the wrench jaws and illustrating the assemblage of the layered metal plate elements of the invention.

The order of assemblage and the nature of the laminated construction of the wrench is more clearly visible in FIG. 2, a side view of the wrench, wherein the tertiary handle 46 is pivotally fixed to the first and second primary handle plates 22 and 24 by rivets 50. The secondary handle 34, comprising the first and second secondary handle plates 36 and 38, pivots within the central opening formed by the handle spacer 26 of the primary handle. The connecting rods 54 and 64 move freely along the outside surface of the tool being pivotally attached to the primary handle 20 by rivets 56 and 66. The connecting rod pin retainers 62 and 72 are pressed on to the connecting rod pin which penetrates the internally mounted lower movable jaw assembly. Retainer plates 76 and 78 cover the jaw roller guide slots thereby keeping the linear roller bearings of the lower movable jaw assembly. The upper jaw further comprises first and second inner upper jaw plates 86 and 88 which complete the upper jaw structure.

Figure 3:
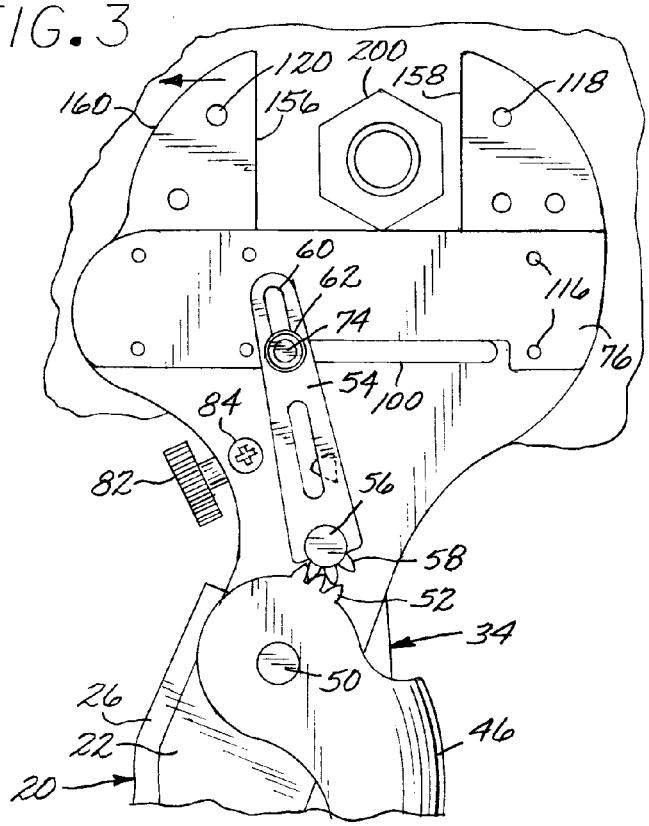
FIG. 3 is a front view of the jaw portion of the present invention of FIG. 1 showing the jaws being opened by activation of the tertiary handle with the jaw opening positioned around a hex fastener.

Referring now to FIG. 3 showing a front view of the top end of the wrench wherein the jaws are opened separating the lower movable jaw assembly 160 jaw face 156 away from the opposing upper stationary jaw face 158 to facilitate positioning the tool around a workpiece 200. The action is initiated by activation of the tertiary handle 46 is better illustrated in FIG. 3 showing the tertiary handle 46 rotated around rivet 50 with gears 52 engaging the connecting rod transfer gear 58 cooperating to move the connecting rod pin 74 through the connecting rod pin guide slot 100 thereby drawing the lower movable jaw assembly 160 away from the upper jaw face 158. The dimensional accommodation provided by the connecting rod guide slot 60 is demonstrated as the connecting rod pin 74 has moved through the slot as the lower movable jaw assembly 160 is slid back. A complementary mechanism is also provided on the reverse side of the tool.

Figure 4:
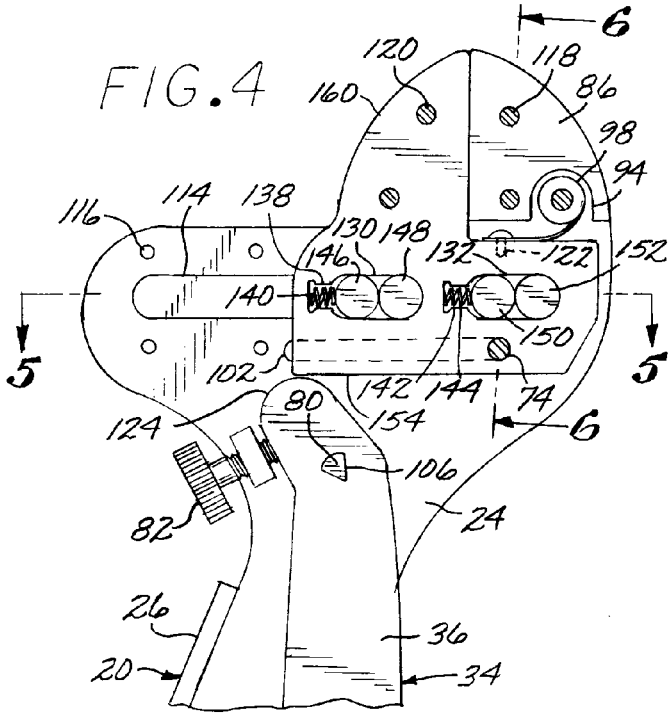
FIG. 4 is a cross section view of the present invention of FIG. 1 taken on Line 4-4 of FIG. 2 showing the spring biased lower movable jaw assembly adjacent to the upper stationary jaw with the secondary handle upper end with binding surface contacting the lower movable jaw assembly.

More details of the lower movable jaw assembly 160 are illustrated in FIG. 4, a section view taken on Line 4-4 of FIG. 2, wherein the negator spring 98 is mounted between the first and second primary handles and within cut outs 94 and 96 of the inner upper jaw plates 86 and 88. The negator spring 98 is pined to the lower movable jaw assembly 160 at 122 thereby providing a spring bias of the lower movable jaw assembly to present a normal closed position of the tool jaws. It will be appreciated that other types of springs or bias mechanisms are also suitable to provide the functionality of the negator spring. The lower movable jaw assembly 160 further comprises first and second inner lower jaw plates 126 and 128 together having first and second linear roller bearing races defined at 130 and 132 in the first inner lower jaw plate 126 and at 134 and 136 in the second inner lower jaw plate 128. With the inner lower jaw plates pinned together with fasteners 120, two races are formed each having a compression spring 140 and 144 mounted between a spring keep 138 and 142 fashioned at one end of each race and the linear roller bearings 146 and 148 of the first race and 150 and 152 of the second race. The compression springs keep the rollers lightly spring loaded in one direction so that they have room to roll unencumbered once load transferal starts taking place. The linear roller bearings extend at each bearing end beyond the surfaces of the lower inner jaw plates to engage the lower movable jaw guide slots 112 and 114 in the primary handle 20. The roller bearings are retained in position by retainer plates 76 and 78 covering the guide slots 112 and 114 and are pinned to the primary handle by fasteners 116. The linear roller bearings insure increased life of the slide mechanism and improve the efficiency of the tool. Briefly referring to FIG. 11, note that the lower movable jaw assembly 160 provides a jaw face total width matching the upper jaw face by incorporating first and second lower movable jaw outer plates 90 and 92 also secured by fasteners 120 and travel in the same plane as the primary handle plates 22 and 24.

Also shown in FIG. 4 is the clamping mechanism of the secondary handle 34. The secondary handle 34 top end has a cam shaped binding surface 124 that engages a flat contact surface 154 of the lower movable jaw assembly 160. The secondary handle 34 pivots around the pendulum pivot pin 80 fixed in the secondary handle plates 36 and 38 at 106 and 108 and through wedge shaped pendulum pivot pin receivers 104 in the primary handle plate 22 and 110 in the second primary handle plate 24 thereby allowing the secondary handle 34 to rotate through a limited arc as defined by the wedge shaped pendulum pin receivers. The advantages of a pendulum pivot pin as compared to a round pin are exemplified by the magnitude of bending and shear strength provided, the reduction in frictional forces during load transfer, and the improved leverage capability. Upon activation of the secondary handle 34 the binding surface 124 engages the flat contact surface 154 of the lower movable jaw assembly 160 at a shallow angle in a knuckle joint action so as to allow large clamping forces to be transferred from the handle 34 to the lower movable jaw assembly 160 and subsequently to the fastener 200. As the secondary handle 34 is not responsible for the full range travel of the lower movable jaw assembly, a much greater mechanical advantage of about 12:1 is achieved in contrast to the typical 3:1 to 5:1 advantage provided by a channel locking type pliers. Note also that the secondary handle binding surface 124 engages the lower movable jaw assembly contact surface 154 in the same manner regardless of the lower movable jaw assembly 160 position.

A knurled knob adjustable stop 82 is further provided engaging the top end of the secondary handle 34 to selectable reduce the lost motion of the secondary handle 34 prior to clamp initiation. The stop is locked in position by screw fastener 84 as illustrated in FIGS. 3 and 4.

Figure 5:
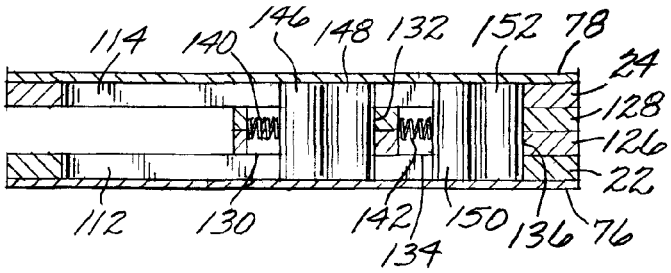
FIG. 5 is a cross section view of the present invention of FIG. 1 taken on Line 5-5 of FIG. 4 showing the first and second retaining plates located on the outer surfaces of the main body and acting as keepers for the rollers of the lower movable jaw assembly.

The linear roller bearing details are illustrated in FIG. 5 showing a sectional view thereof. The roller bearings, the rollers of the linear roller bearing, 146, 148, 150 and 152 are illustrated with the roller bearing ends riding in the guide slots 112 and 114 of the primary handle plates 22 and 24, being retained in place by retainer plates 76 and 78, riding in the lower movable jaw assembly in a first race defined by 130 and 132 and in a second race defined by 134 and 136. of the inner movable jaw plates 126 and 128. The compression springs 140 and 144 are also shown in position biasing each set of roller bearings.

Figure 6:
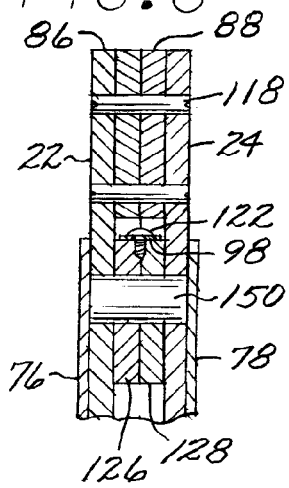
FIG. 6 is a cross section view of the present invention of FIG. 1 taken on Line 6-6 of FIG. 4 showing details of the pinned assembly of the upper stationary jaw.

Now referring to FIG. 6, the spatial orientation of the lower movable jaw assembly linear roller bearings relative to the upper stationary jaw are visible wherein the laminated construction of the upper stationary jaw element is formed by the stacked combination of the primary handle plate 22, the first and second inner upper jaw plates 86 and 88 all being pinned together by fasteners 118. The lower movable jaw assembly portion formed by inner lower movable jaw plates 126 and 128 is positioned within the primary handle and retained in position by the linear roller bearings, one seen at 150, engaged in the primary handle plates and kept by retainer plates 76 and 78. The location of the negator spring 98 attachment 122 to the lower movable jaw assembly is also visible.

Figure 8:
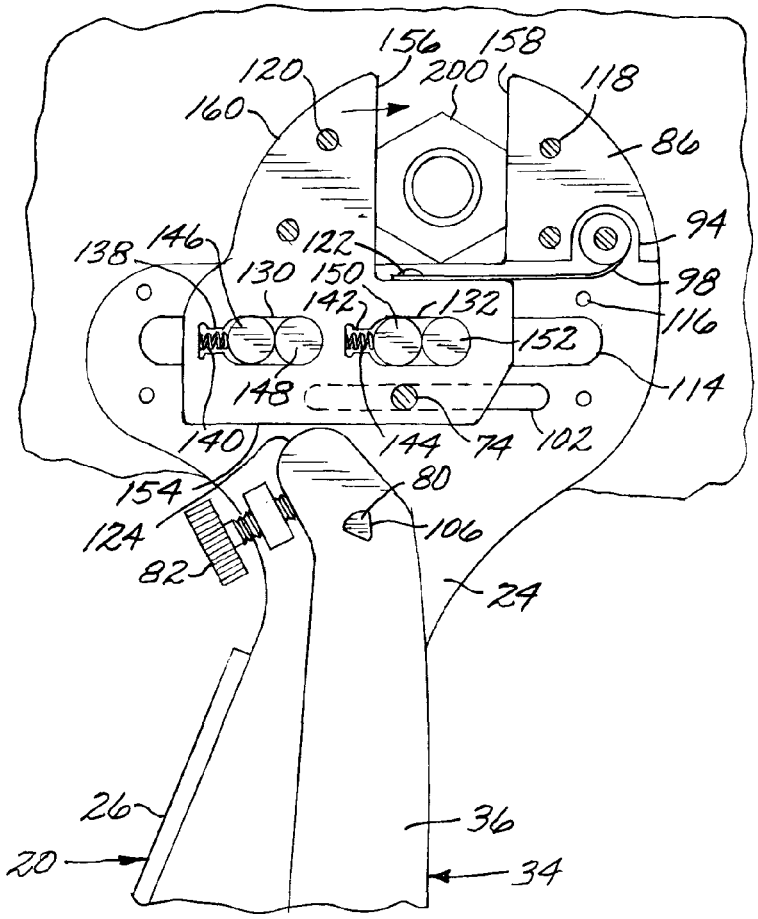
FIG. 8 is similar to FIG. 4 showing the jaws of the present invention positioning against a hex fastener.
Figure 9:
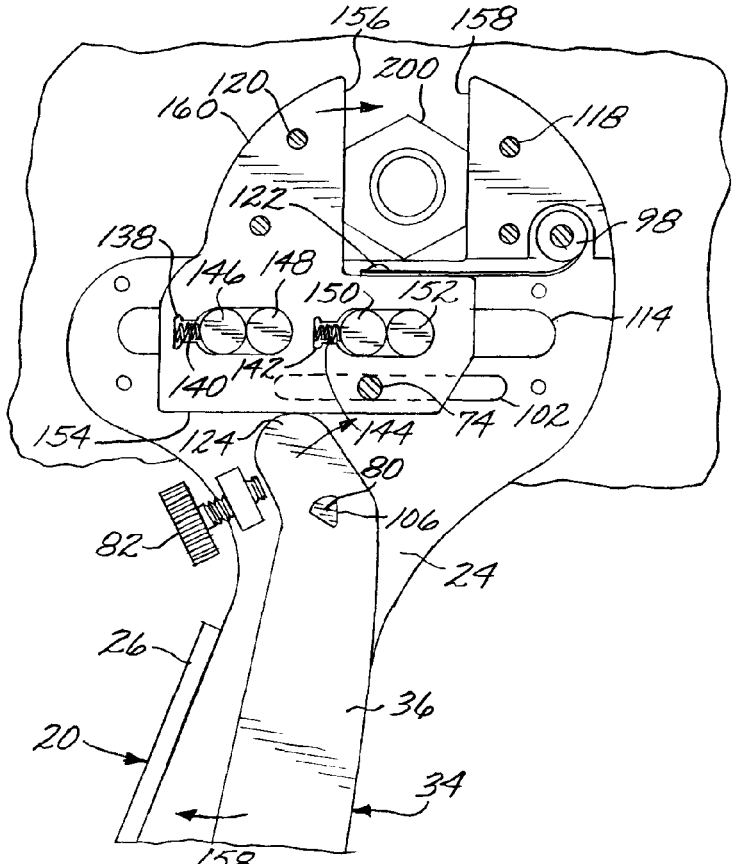
FIG. 9 is the same view as FIG. 8 showing the secondary handle binding surface contacting and pressing against the lower movable jaw assembly so as to firmly lock the jaw assembly in place and to contact the hex fastener with a substantial gripping force.
Figure 10:
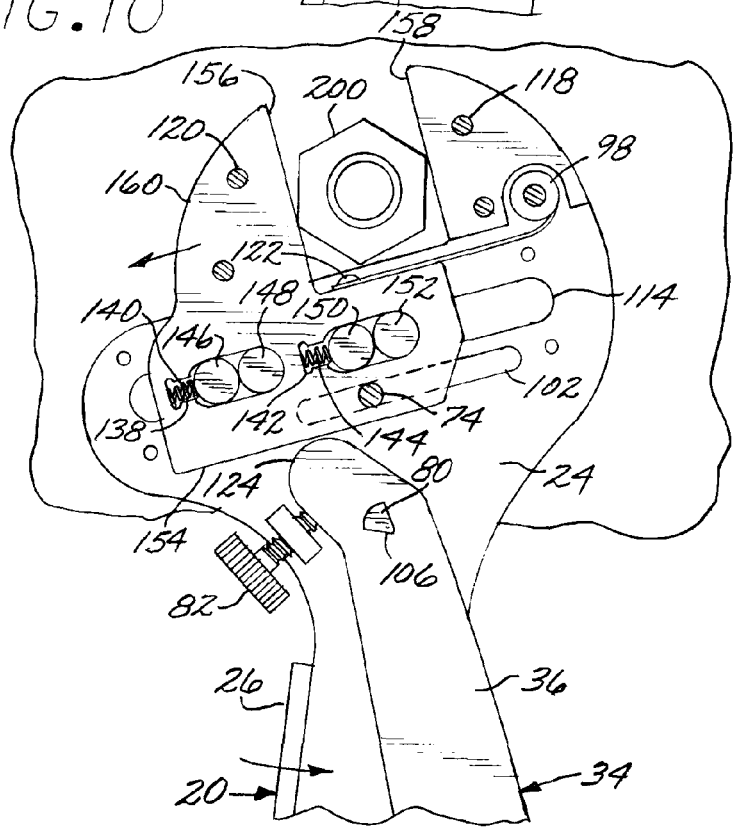
FIG. 10 is the same as FIG. 9 with the wrench arranged for a return stroke wherein pressure is relieved from the secondary handle thereby allowing a quasi ratcheting action.

The torque stroke and the quasi ratcheting action is illustrated in FIGS. 8, 9 and 10 to which are now referred. As in FIG. 8, when the tool engages a workpiece, such as the hex fastener at 200, the jaw faces 156 and 158 are lightly resting on the fastener surface by forces provided by the negator spring 98 which biases the jaws to a normally closed position and drawing the jaws together as shown. The lower movable jaw assembly 160 is positioned at the corresponding position within jaw roller guide slot 114. The secondary handle 34 has not been asserted and is resting such that the cam shaped binding surface 124 is not clamping against the lower movable jaw assembly contact surface 154. In the illustrated configuration the jaws are not clamped into place. In preparation for the torque stroke of the wrench, FIG. 9 illustrates the secondary handle 34 being asserted, the elongate handle grip portion being drawn towards the primary handle 20. The secondary handle 34 now pivots around pendulum pivot pin 80 thereby moving the cam shaped binding surface 124 of the handle to engage and bind against the lower movable jaw assembly contact surface 154 at a shallow angle providing a highly leveraged clamping of the lower jaw face 156 onto the fastener 200. The tool, now clamped in a knuckle joint style, is rotated in either direction in a torque stroke as required. A quasi ratcheting action is next provided on the return stroke, as shown in FIG. 10, where pressure is now lightened on the secondary handle 34, thereby relaxing the clamp of the secondary handle top binding surface 124 on the contact surface 154 of the lower movable jaw assembly 160 such that the jaw assembly is not free to move within the jaw bearing guide slot. The operator executes the return stroke and the jaw opening widens to accommodate repositioning the jaws onto another set of fastener surfaces in preparation for the next torque stroke. The negator spring 98 insures that the jaw faces remain in contact with the fastener 200. The process is repeated as required wherein the operator asserts the secondary handle 34 with force during the torque stroke and lights the grip during the return stroke thereby effectuating a quasi ratcheting action without necessitating removal of the tool from the workpiece.

While an embodiment of the invention has been illustrated and described, variations and modifications may be apparent to those skilled in the art. Therefore, we do not wish to be limited thereto and ask that the scope and breadth of this invention be determined from the claims which follow rather than the above description.

What is claimed is:

1. An adjustable ratcheting open ended wrench comprising a primary handle having a top end forming an upper stationary jaw element having a jaw face, a bottom end providing an elongate handle grip portion, a linear roller bearing guide slot arranged perpendicularly to the upper stationary jaw element jaw face, and a connecting rod pin guide slot arranged parallel to the linear roller bearing guide slot, a lower movable jaw assembly having a top and a bottom, a jaw face forming the top disposed to oppose and compliment the upper jaw element jaw face, a flat contact surface on the bottom, and a linear roller bearing, having at least one race and a plurality of rollers, wherein the linear roller bearing rollers engage the linear roller bearing guide slot of the primary handle, a spring secured between the primary handle and the lower movable jaw assembly being arranged to spring bias the lower movable jaw assembly jaw face towards the upper stationary jaw element jaw face providing a normally closed jaws configuration, a secondary handle having a thickness, top and bottom ends, a cam shaped binding surface forming the top end and an elongate handle grip portion forming the bottom end, and being fastened by means of a first pivotal fastener to the primary handle in a scissor fashion with the secondary handle elongate handle grip portion opposing the primary handle elongate handle grip portion and arranged such that the cam shaped binding surface may selectively engage the lower movable jaw assembly flat contact surface, a tertiary handle having top and bottom ends, an elongate handle portion forming the bottom end, and at least one gear element forming the top end, being pivotally attached to the primary handle near the tertiary handle top end by means of a second pivot fastener, and, a first connecting rod having a longitudinal length, a top end, and a bottom end formed as a transfer gear disposed to engage the tertiary handle gear element, the rod further being pivotally fixed, by means of a third pivot fastener near the transfer gear, to the primary handle, the rod top end having a longitudinally oriented guide slot pivotally and perpendicularly engaging a first connecting rod pin, the pin being secured to the lower movable jaw assembly and retained by the connecting rod pin guide slot in the primary handle, whereby the tertiary handle is operable to open the normally closed jaw faces and the secondary handle is operable to clamp the lower movable jaw assembly in place and grip a workpiece presented between the jaws.

2. The adjustable ratcheting open ended wrench as in claim 1 wherein the first pivotal fastener fastening the secondary handle to the primary handle comprises a pendulum pivot pin secured in the secondary handle and a wedge shaped pendulum pivot pin receiver in the primary handle.

3. The adjustable ratcheting open ended wrench as in claim 1, wherein the spring between the lower movable jaw assembly and the primary handle is a negator spring.

4. The adjustable ratcheting open ended wrench as in claim 1, wherein the primary handle is of laminated construction comprising first and second primary handle plates having a handle spacer mounted between the first and second primary handle plates wherein the handle spacer has a thickness being at least the thickness of the secondary handle.

5. The adjustable ratcheting open ended wrench as in claim 1, wherein the secondary handle is of laminated construction comprising at least two secondary handle plates being fastened together to form the secondary handle.

6. The adjustable ratcheting open ended wrench as in claim 4 wherein the secondary handle is disposed between the first and second primary handle plates.

7. The adjustable ratcheting open ended wrench as in claim 1, wherein the lower movable jaw assembly is of laminated construction and further comprises at least two inner plates together having at least one opening formed to provide the linear roller bearing race and disposed to retain the linear roller bearing rollers perpendicularly oriented to the assembly.

8. The adjustable ratcheting open ended wrench as in claim 4, wherein the first and second primary handle plates each have a connecting rod pin guide slot portion together forming the primary handle connecting rod pin guide slot and a linear roller bearing guide slot portion together forming the primary handle linear roller bearing guide slot.

9. The adjustable ratcheting open ended wrench as in claim 8, wherein lower movable jaw assembly is mounted between the first and second primary handle plates with the ends of the linear roller bearing rollers of lower movable jaw assembly retained respectively by the linear roller bearing guide slot portions in the first and second primary handle plates.

10. The adjustable ratcheting open ended wrench as in claim 8 wherein the wrench, having front and rear sides, the first connecting rod disposed on the front side and a second connecting rod, having the same elements of the first connecting rod, is similarly fastened to the primary handle on the rear side, the connecting rod slot of the second connecting rod pin guide slot engaging a second connecting rod pin also disposed on the rear side, and wherein the tertiary handle further comprises front and rear portions respectively disposed on opposing front and rear sides of the wrench wherein the tertiary handle portions minor each other and have identical elements thereby together provide front and rear tertiary handle top end gear elements engaging the transfer gears of the first and second connecting rods.

11. The adjustable ratcheting open ended wrench as in claim 1, wherein the primary handle further comprises an adjustable stop arranged to engage the top end of the secondary handle providing a means to adjust the lost motion of the secondary handle.

12. The adjustable ratcheting open ended wrench as in claim 1, wherein the primary handle and secondary handle are manufactured from metal.

13. The adjustable ratcheting open ended wrench as in claim 1, wherein a retainer plate is positioned over the linear roller bearing guide slot to retain the linear roller bearing rollers within the linear roller bearing.

14. The adjustable ratcheting open ended wrench as in claim 1, further comprising a handle bias spring mounted between the handle grip ends of the primary and secondary handles so as to bias the secondary handle cam shaped binding surface away from the flat contact surface of the lower movable jaw assembly.

* * * * *